United States Patent [19]

Guelfi et al.

[11] Patent Number: 5,067,192

[45] Date of Patent: Nov. 26, 1991

[54] AUTOMATIC MACHINE FOR WASHING SELF-SERVICE TRAYS AND SIMILAR ITEMS

[75] Inventors: Ferdinando Guelfi; Elio Lippi, both of Lucca, Italy

[73] Assignee: Colged S.p.A., Lucca, Italy

[21] Appl. No.: 622,023

[22] Filed: Dec. 4, 1990

[30] Foreign Application Priority Data

Dec. 4, 1989 [IT] Italy ..... 9577 A/89

[51] Int. Cl.[5] ..... A47L 5/38

[52] U.S. Cl. ..... 15/302; 15/309.2; 15/316.1

[58] Field of Search ..... 15/302, 309.2, 316.1

[56] References Cited

U.S. PATENT DOCUMENTS

| | | | |
|---|---|---|---|
| 2,413,937 | 1/1947 | Zademach et al. | 15/309.2 X |
| 2,666,711 | 1/1954 | Crossett | 15/309.2 X |
| 3,805,316 | 4/1974 | Sheppard | 15/309.2 |
| 4,473,922 | 10/1984 | Weihe | 15/309.2 |

*Primary Examiner*—Chris K. Moore

*Attorney, Agent, or Firm*—Browdy and Neimark

[57] ABSTRACT

In an automatic machine for washing self-service meal trays, comprising a sucker (7) by which soiled trays (3) are picked up from a trolley (2) and set down on a conveyor extending through a wash-and-dry tunnel (5) and running out to a restacking trolley, a first improvement consists in the addition of a device (12) by means of which compressed air is blown at the tray (3*a*) to the end of removing any waste matter and ensuring that the sucker (7) can apply a firm grip. A second improvement lies in the adoption of a power driven, horizontally disposed conveyor belt (16) on which the trays remain stably positioned by virtue of their own weight, free of mechanical constrains, so that any size and shape of tray can be handled without alteration to the machine, and cleansed in its entirety. Once washed, the trays are cleared of rinsing water by a blast of cold air before being dried off with further jets of air.

4 Claims, 3 Drawing Sheets

AUTOMATIC MACHINE FOR WASHING SELF-SERVICE TRAYS AND SIMILAR ITEMS

FIELD OF THE INVENTION

The present invention relates to an automatic machine for washing self-service meal trays and the like, and more particularly to certain improvements in such a machine.

DESCRIPTION OF THE PRIOR ART

In conventional machines for washing and drying trays, for example plastic or metal trays as used in self-service eating places, the trays are taken from a conveyor belt or a level-stacking trolley, washed, dried, and deposited on a further belt or trolley. The entire procedure is automatic, such that the operator has only to replace the trolleys loaded with the washed or soiled trays. In certain machines of the type in question, soiled trays are picked up with a sucker reciprocated by a pneumatic cylinder, then set down on a conveying system and carried through a tunnel, internally of which they are washed by brushes and water jets, and dried.

To enable the washing water to drain freely from the edge of the tray, the conveying system operates on a gradient, the tray being propelled through a rising trajectory by sets of pinch wheels that grip the edge. With a system such as this, it becomes impossible to wash trays having an insufficiently broad edge, or to wash trays of different sizes, and the machine must therefore be adapted specially for operation with each individual type of tray. Moreover, the part of the tray handled by users tends to remain unwashed despite being considerably soiled, whereas thorough cleansing is particularly necessary if acceptable standards of hygiene are to be ensured.

A further drawback encountered in machines of this type derives from the method whereby soiled trays are taken up from the trolley utilizing suction and transferred to the conveying system. The sucker is not always able to establish a firm grip, due to the presence of matter that may be missed when the tray is wiped before being stacked on the trolley; for example, a matchstick or toothpick occupying the area engaged by the sucker obviously will not allow the necessary vacuum to be generated through the cup, and the tray therefore cannot be lifted. In addition, it is all too easy for an item such as a toothpick to find its way into the filters of the washing machine, occasioning damage to the pumping equipment and giving substandard cleansing results, given that the spray nozzles of such equipment may also become obstructed.

Finally, the machines in current use are designed to operate a hot wash-and-dry cycle. This adversely affects the durability and the strength of trays fashioned from plastic which, when stacked hot on a trolley, will cool quickly around the periphery and more slowly in the middle. The result is that the trays become distorted, and their external surfaces damaged.

The object of the present invention is to introduce certain improvements into an automatic machine for washing self-service trays and similar items, such as will overcome the drawbacks mentioned above and make the machine more efficient.

SUMMARY OF THE INVENTION

The stated object is realized in an automatic tray washing machine affording improvements according to the present invention comprising a sucker operated by pneumatic cylinders and serving to pick up soiled trays from a first stacking trolley, and a conveying system by which the soiled trays are taken through a washing a drying tunnel to a second stacking trolley, such improvements comprising a cleaning device in a position coinciding substantially with that of the sucker, having a reservoir charged with compressed air from which jetting means extend for directing air at the tray about to be picked up by the sucker, whereby the tray is cleared of any residual waste matter thus enabling the sucker to establish a firm grip, said conveying system consisting in a horizontally disposed power driven belt on which the trays, remaining freely positioned by virtue of their own weight, are drawn through the machine free of any mechanical constraint and thus washed, rinsed and dried in their entirety; such a belt can therefore accommodate trays of different shapes and sizes.

The improvements comprise further air jetting means positioned beyond the washing station, which serve to blast away any water remaining in the tray, thus facilitating the successive drying step.

BRIEF DESCRIPTION OF THE DRAWINGS

The invention will now be described in detail, by way of example, with the aid of the accompanying drawings, in which.

DESCRIPTION OF A PREFERRED EMBODIMENT

Figure 1:
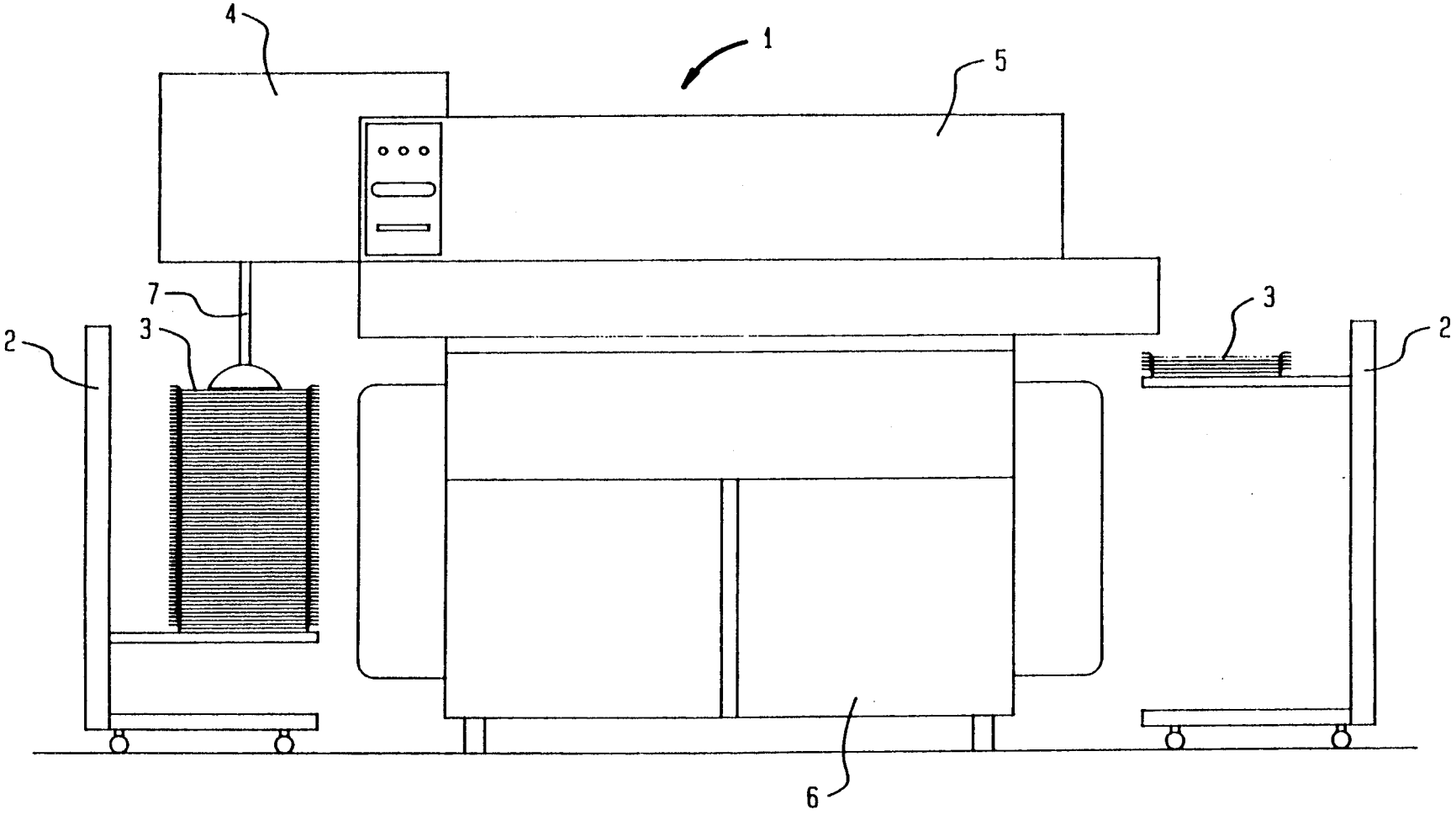
FIG. 1 is a longitudinal elevational view of the improved automatic tray washing machine according to the invention, seen in its entirety.

With reference to FIG. 1, an automatic machine 1 for washing self-service meal trays, incorporating the improvements of the present invention, comprises a first level-stacking trolley 2 loaded with soiled trays 3, and a system 4 by which the trays 3 are picked up and transferred into a washing and drying tunnel 5 resting on a main frame 6. The washed and dried trays 3 are stacked on a second trolley 2.

Figure 3:
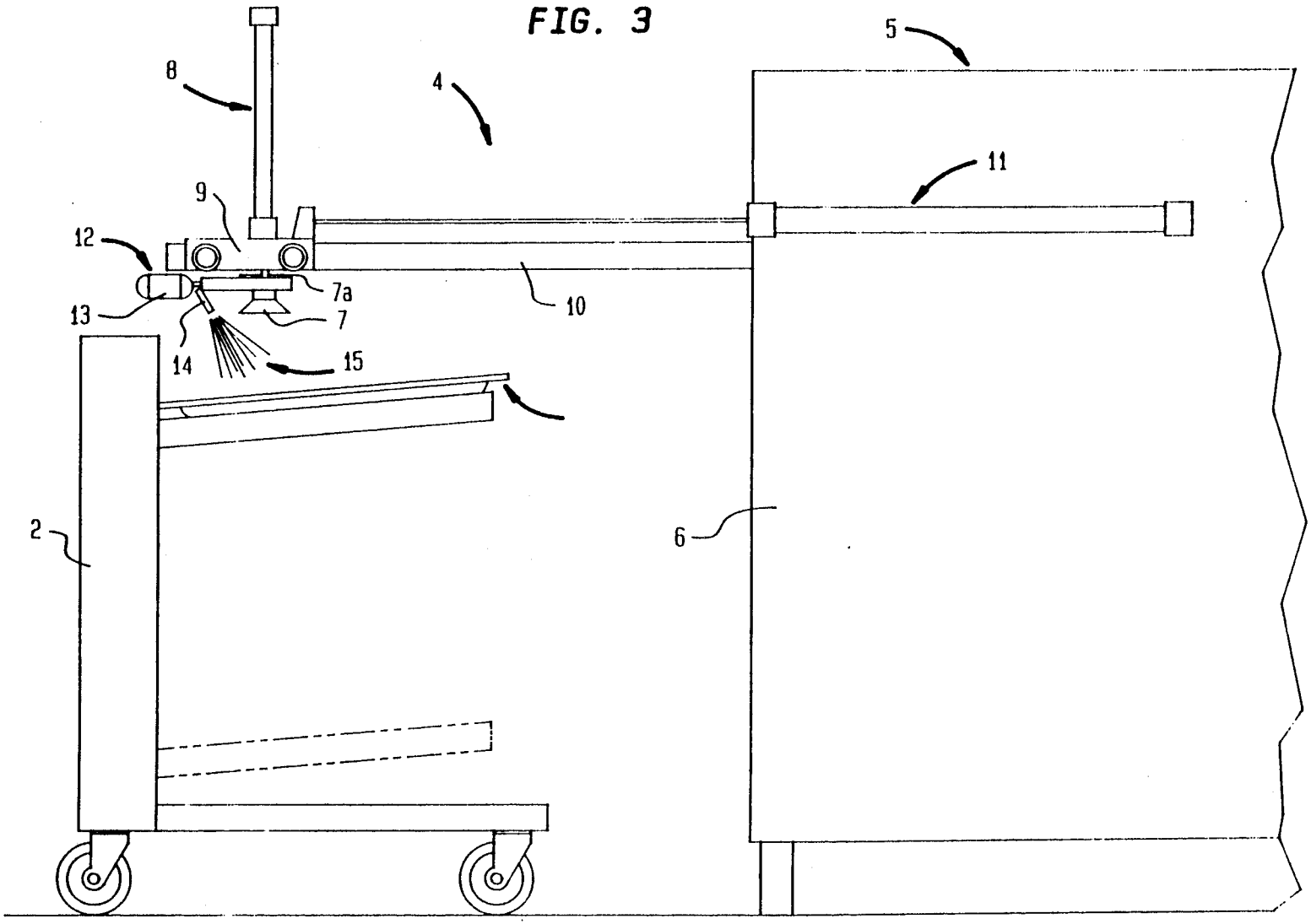
FIG. 3 shows the system, in its entirety, by which trays are picked up and directed into an improved machine according to the invention.

Referring to FIG. 3, the system 4 by which trays 3 are picked up and transferred comprises a sucker 7 reciprocated vertically by a pneumatic cylinder 8 rigidly associated with a carriage 9 and capable thus of traversing along horizontal guides 10, the relative horizontal movement being produced by a second pneumatic cylinder 11. A blowing device is located alongside the sucker 7, and comprises a reservoir 13 and an alongated nozzle 14 extending from the latter and operates intermittently to direct a jet of compressed air 15 at the tray **3*a* currently about to be picked up by the sucker 7. Negative pressure is generated internally of the sucker 7 by a vacuum pump 7*a*. The jet of compressed air 15 is activated by a conventional pneumatic device (not illustrated) that operates immediately before the sucker 7 begins its vertical approach toward the tray 3*a* by the action of the corresponding pneumatic cylinder 8. According to the invention, the exposure of each soiled tray 3*a* to a jet of air 15 ensures the forcible removal of any residual food, paper, toothpicks, matchsticks etc., that may happen to have remained after a cursory wipe effected as the tray was stacked on the trolley 2. Thus, the sucker 7 is able to lay hold on the tray 3***a* more easily, thanks to the absence of any traces of matter that might prevent the requisited negative pressure from being generated through the suction cup. Removed from the tray 3 moreover, such unwanted matter can no longer penetrate the filters of the pumping equipment of the washing machine and occasion the difficulties mentioned at the outset.

Figure 2:
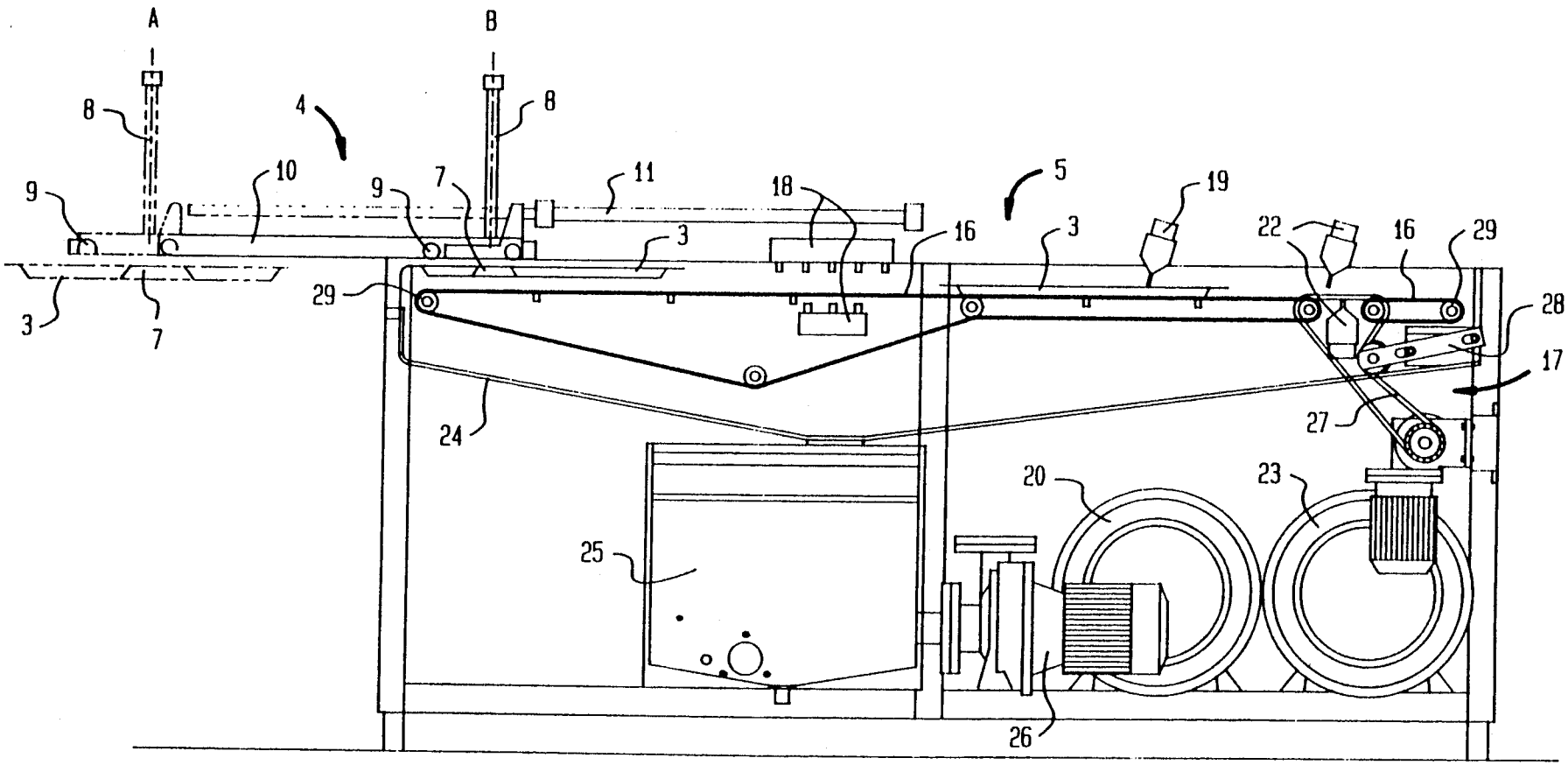
FIG. 2 is a longitudinal elevational view of the interior of an improved machine according to the invention.

As shown in FIG. 2, each tray 3 picked up by the sucker 7 is traversed by the horizontal cylinder 11 from the position denoted A to that denoted B and placed on a horizontally disposed conveyor belt 16 operated by drive means denoted 17. By reason of their weight, and the friction generated by contact with the belt 16, the trays 3 are conveyed stably through a plurality of washing and rinsing spray nozzles 18. With the conveyor belt 16 horizontally disposed, trays 3 can be carried forward without any gripping or constraining means being required. Each tray is therefore cleansed in its entirety, and especially around the edge. What is more, the belt 16 is able to accommodate and convey trays of different size at any given moment.

Rinsing water left in the trays 3 after the washing operation is removed forcibly with a jet of cold air from a nozzle 19 connected to a centrifugal compressor 20. Thereafter, the trays are conveyed through more jets of cold air from drier nozzles 22 connected to a further centrifugal compressor 23, and then stacked on the second trolley 2. Utilizing cold air for drying purposes, it becomes possible to eliminate those drawbacks experienced when trays are stacked hot, as mentioned above.

In FIG. 2 of the drawings, 24 denotes the draining through into which the soiled washing water falls, 25 the relative collection tank, 26 the pump by which water is supplied to the washing nozzles 18, 27 and 28 the geared motor, chain and tensioner by which the conveyor belt 16 is driven, and 29 the rollers about which the conveyor belt 16 is looped.

We claim:

1. Improvements to an automatic machine for washing self-service meal trays, comprising a sucker (7) operated by pneumatic cylinders (8, 11) and serving to pick up soiled trays (3) from a first stacking trolley (2), and a conveying system by which the soiled trays are taken through a washing and drying tunnel (5) toward a second trolley (2) on which the washed and dried trays are restacked, wherein the improvements comprise a cleaning device (12) occupying a position coinciding substantially with that of the sucker (7), said device comprising a reservoir (13) charged with compressed air, and means (14) associated with the reservoir by which a jet of compressed air (15) is directed at each successive tray (3*a*) immediately prior to the approach of the sucker, in such a way as to clear the tray of any residual waste matter and enable the sucker to establish a firm grip, said conveying system (16, 17) consisting of a horizontally disposed power driven belt extending the entire length of the tunnel (5), on which the trays (3) remain in position without the use of constraints, means being further provided for emptying the trays of rinsing water before being dried, installed internally of the tunnel (5) and beyond the washing station (18).

2. Improvements to an automatic tray washing machine as in claim 1, wherein said means for emptying the trays of rinsing water consist in at least one air jet generated by a compressor (20) and directed through a nozzle (19) at the tray in such a way as to bring about a forcible removal of any remaining water thus allowing to dry the tray thereafter with further air jets.

3. Improvements to an automatic tray washing machine as in claim 2, wherein the air of the jets by which trays are emptied of water and dried is cold air.

4. Improvements to an automatic tray washing machine as in claim 1, wherein said means (14) by which a jet of compressed are (15) is directed at each succesive tray (3*a*) prior to the approach of the sucker comprise at least one elongated nozzle projecting from the reservoir (13).

* * * * *